US006116528A

United States Patent [19]

Schwelling

[11] Patent Number: 6,116,528

[45] Date of Patent: Sep. 12, 2000

[54] SAFETY SWITCH FOR PAPER SHREDDERS

[76] Inventor: Hermann Schwelling, Hartmannweg 5, D-88682 Salem, Germany

[21] Appl. No.: 09/214,044

[22] PCT Filed: Apr. 28, 1998

[86] PCT No.: PCT/EP98/02516

§ 371 Date: Apr. 27, 1999

§ 102(e) Date: Apr. 27, 1999

[87] PCT Pub. No.: WO98/48937

PCT Pub. Date: Nov. 5, 1998

[30] Foreign Application Priority Data

Apr. 28, 1997 [DE] Germany ..... 197 17 918

[51] Int. Cl.[7] ..... B02C 25/00

[52] U.S. Cl. ..... 241/36; 241/37.5; 241/100; 241/236

[58] Field of Search ..... 241/37.5, 36, 34, 241/100, 236

[56] References Cited

U.S. PATENT DOCUMENTS 5,772,129 6/1998 Nishio et al. ..... 241/36

FOREIGN PATENT DOCUMENTS 3238531 4/1984 Germany .
8707984 3/1989 Germany .
196 18 478 9/1997 Germany .
2117668 10/1983 United Kingdom .

*Primary Examiner*—Mark Rosenbaum
*Attorney, Agent, or Firm*—Friedrich Kueffner

[57] ABSTRACT

In a safety switch for paper shredders, the housing (1) for the cutting mechanism is set on the container (2) for the paper to be cut. The switch element (3), including its pin (3*a*) and the corresponding switching cam, is arranged on the paper collecting container in a working line (W) inclined relative to the vertical (V) of the apparatus.

6 Claims, 4 Drawing Sheets

SAFETY SWITCH FOR PAPER SHREDDERS

BACKGROUND OF THE INVENTION

1. Field of the Invention

The invention relates to a safety switch primarily for those types of paper shredders in which the cutting mechanism housing containing the cutting tools is placed loosely on the cut paper collecting container.

2. Description of the Related Art

This group of devices is more and more used in private residences particularly in the form of so-called particle cutters for destroying confidential records, such as bills, bank statements, official letters, etc., so that in view of the access by small children and the play activity of small children very special safety precautions must be taken by the manufacturers of the devices to ensure that nobody can move their fingers from below into the running cutting mechanism through the discharge gap for the cut material.

SUMMARY OF THE INVENTION

Accordingly, it is the object of the present invention to provide a simple and absolutely reliable drive disconnection which is suitable for this purpose and occurs already when the smallest lifting movement from any side of the housing occurs. The core and simultaneously the technical teaching of the present invention is the arrangement of the safety switch at the housing including switching pin and counter-cam on the cut paper collecting container at an angle to the vertical; the order of magnitude of this angle advantageously corresponds to about 45°.

BRIEF DESCRIPTION OF THE DRAWING

In addition, with the aid of an essentially schematic drawing sketch and a detailed description, the invention will be explained below in more detail; in the drawing.

DESCRIPTION OF THE PREFERRED EMBODIMENTS

Figure 1:
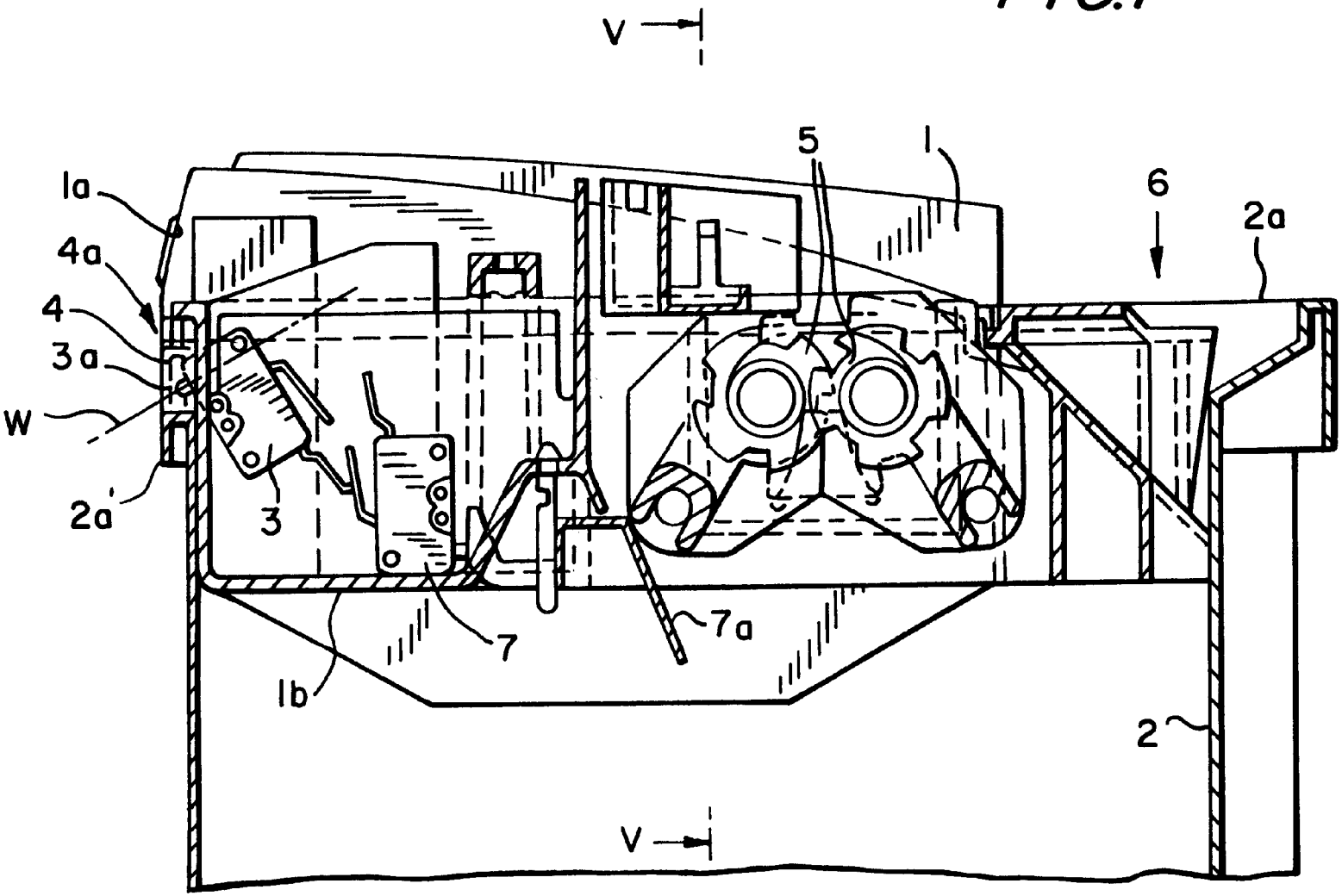
FIG. 1 is a system cross-section through the upper part of the cutting mechanism including the upper portion of the cut paper collecting container.
Figure 2:
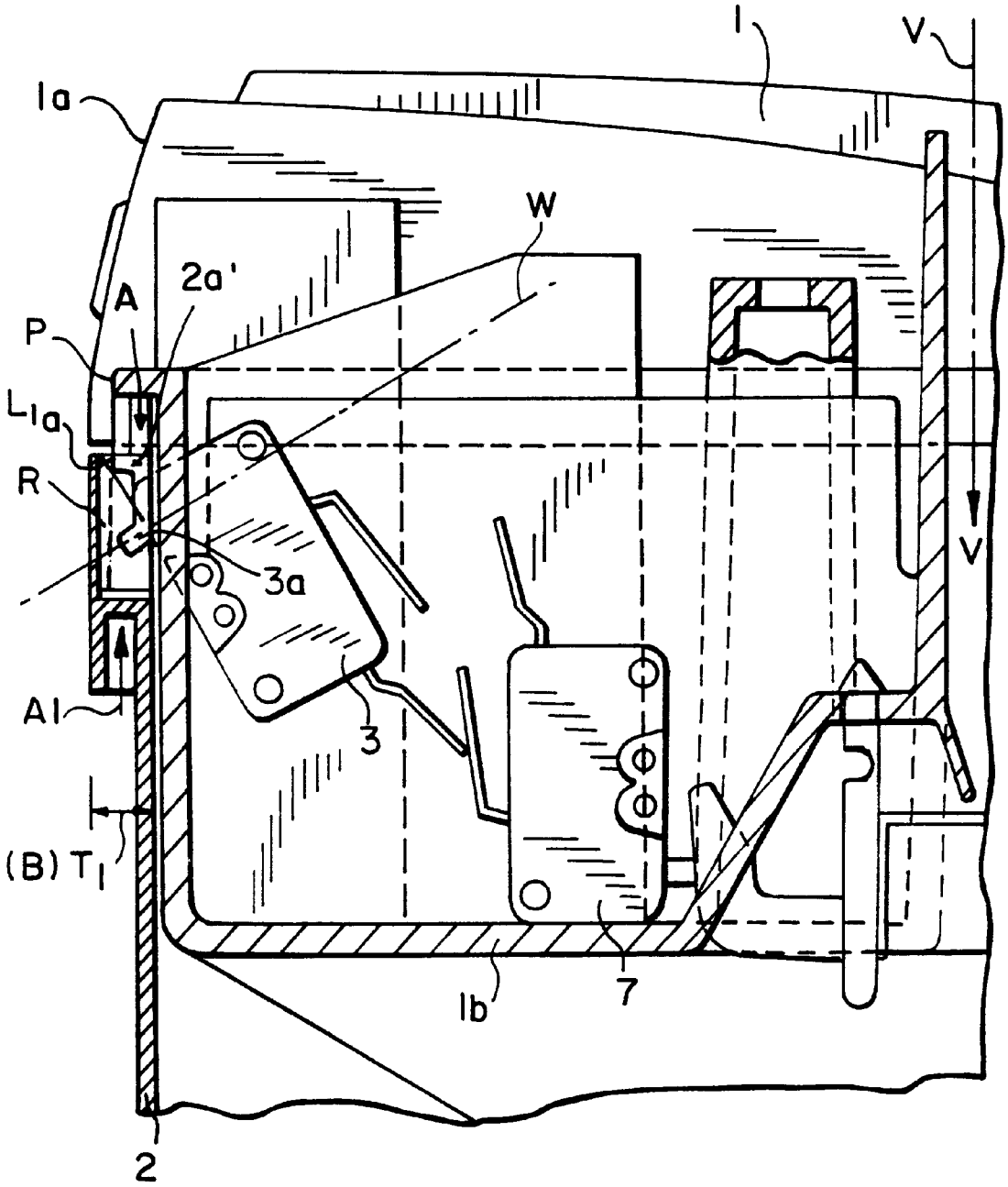
FIG. 2 shows the limit switch area of the same illustration enlarged to about 1:1.

The conventional basic construction of the illustrated paper shredder is formed by the cutting mechanism housing 1, 1*a* including lower tray 1*b* and cutting mechanism 5 placed on the upper edge 2*a* of the cut paper collecting container 2. The basic system is completed by a switching element 3 at the housing 1 for stopping the drive including a switching pin 3*a* and switching cam 4 at the upper container edge 2*a*.

The novel and inventive aspect in such a device is the fact that the switching pin 3*a* of the safety switch and has a line of influence W extending perpendicularly relative to an inclined surface 4*a* of the stop cam 4 in the inner area 2*a*' of the upper container edge 2*a* and this line of influence W is inclined relative to the vertical axis V of the paper shredder 1, 2, wherein, in a special configuration, the switching cam 4 actuating the safety switch 3 is located a significant vertical distance $P_1$ below the imaginary point of rotation P formed by the placement of the cutting mechanism housing 1 on the upper container edge 2*a*.

As a result of this novel and particular arrangement of the safety switching elements, the device is switched off immediately as soon as the cutting mechanism housing 1 is moved even by only a tiny distance out of its basic position; this is because, in conventional devices the deficiencies with respect to safety technology were primarily due to the fact that it was possible to lift at least one side of the cutting mechanism housing and grasp into the interior of the container while the switching cam still actuated the limit switch.

Figure 3A:
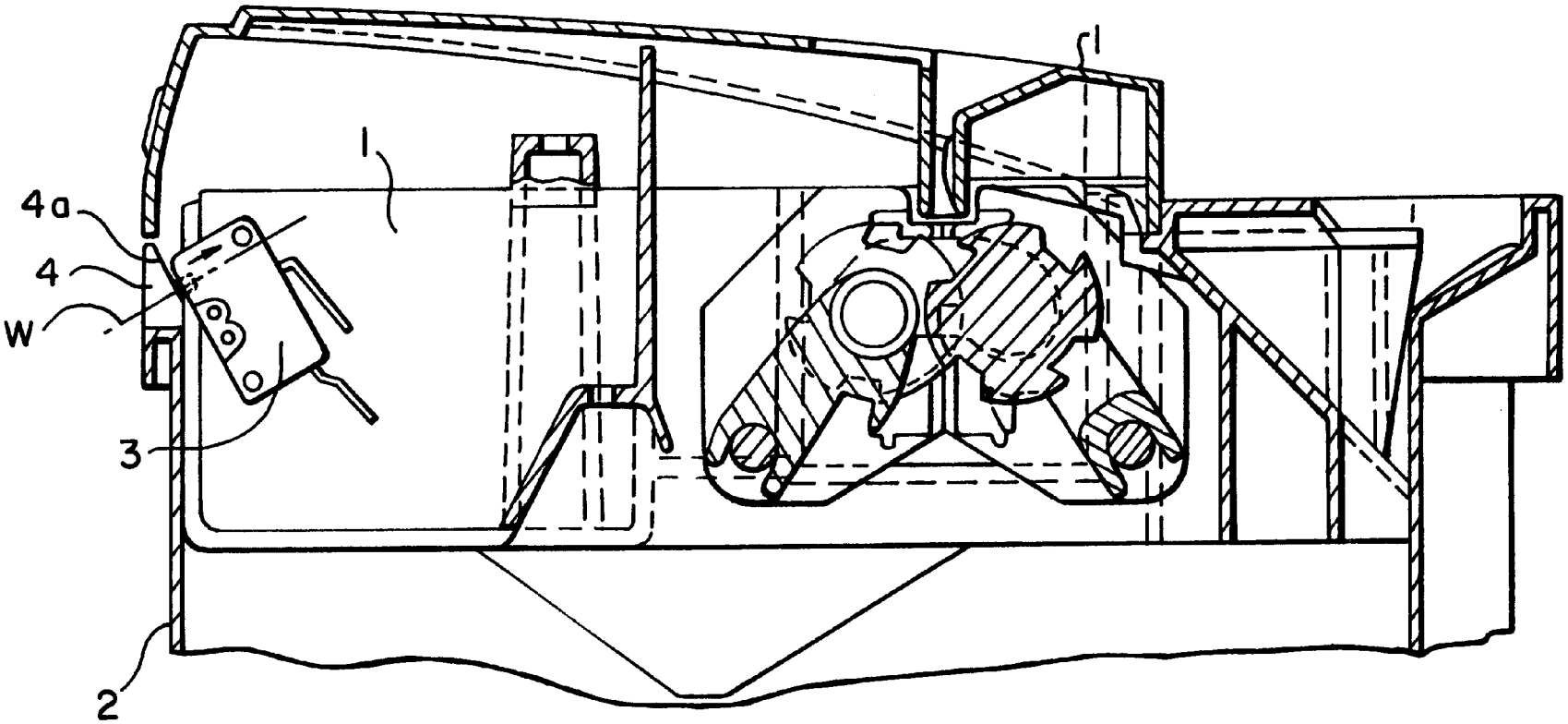
FIGS. 3*a* and 3*b* are additional views showing the limit switch area.
Figure 3B:
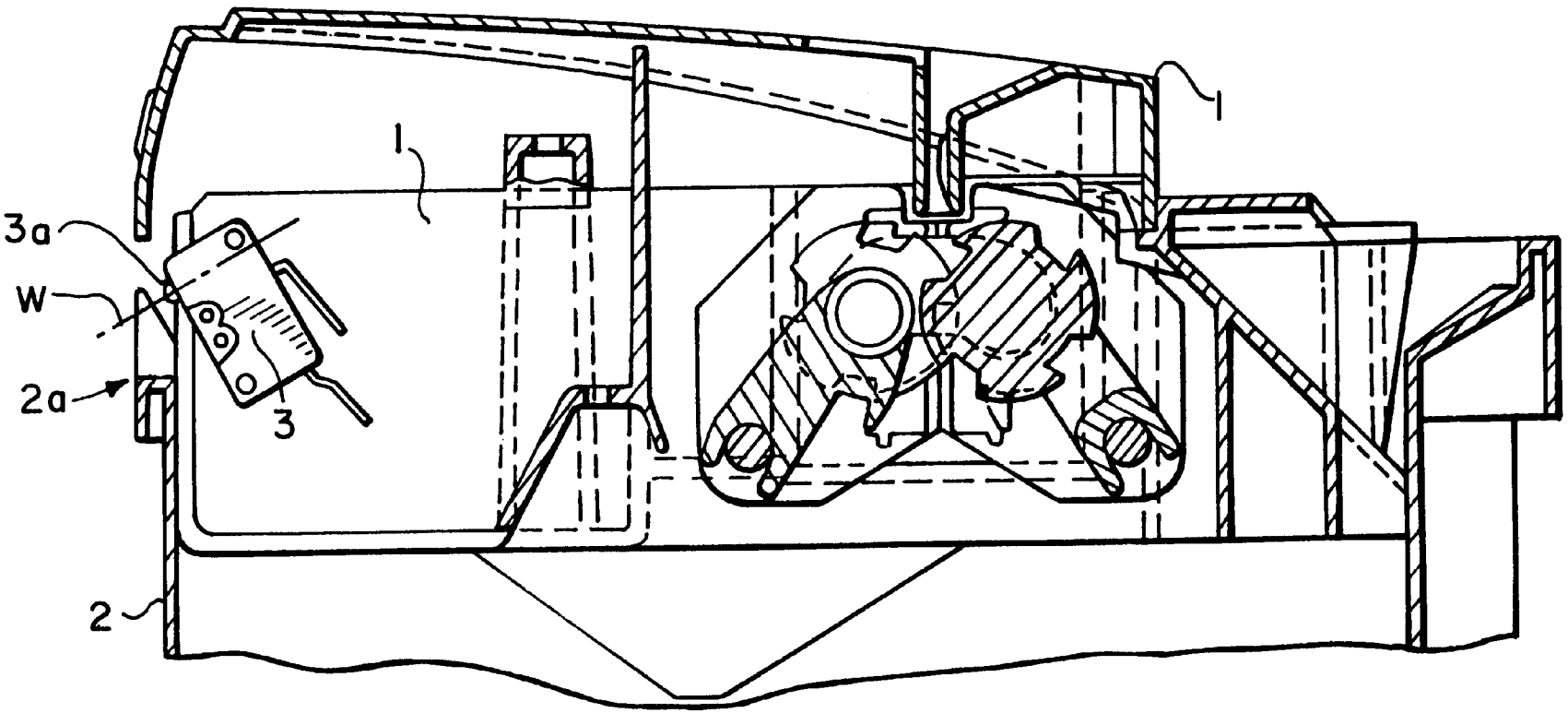

FIGS. 3*a* and 3*b* show the cutting mechanism area in more detail. Specifically, FIG. 3*a* shows the safety switch in the actuated position and FIG. 3*b* shows the safety switch when not actuated, i.e., when the cutting mechanism housing is lifted from the collecting container 2. The drawing shows in FIGS. 3*a* and 3*b* that the line of influence W of the switching pin 3*a* of the safety switch extends perpendicularly of the inclined surface 4*a* of the actuating cam 4. As is apparent from the drawings, this line of influence W extends at an angle relative to the vertical direction.

In the novel configuration presented here for the first time, it is additionally possible to place the housing 1 from the top or the front side onto the cut paper collecting container 2 without the switching cam 4 damaging the safety switch 3, 3*a*.

In accordance with a special structural development of the novel configuration, it is provided that the switching pin 3*a* at the rear side 1*a* of the housing is located in the interior of a gap-like narrow recess A, the depth T of the gap is formed or enlarged by two parallel ribs R protruding from the rear side 1*a* of the housing, and the stop or actuating cam 4 on the side of the container including its inclined surface 4*a* for the switching pin 3*a* is mounted so as to be forwardly flush in a corresponding recess $A_1$ of the upper container edge 2*a* having an increased thickness, wherein operationally the depth $T_1$ and the width B of the upwardly open recess $A_1$ in the container edge is adapted to the outer dimension of the ribs R at the rear side 1*a* of the housing.

What is claimed is:

1. A safety switch for paper shredders including a cutting mechanism housing containing cutting tools, wherein the cutting mechanism housing is loosely placed on an upper edge of a cut paper collecting container, the safety switch comprising a switching element attached to the housing and a stop cam mounted in an inner area of the upper edge of the collecting container for activating a drive and for stopping the drive when the cutting mechanism housing is lifted from the collecting container, wherein the switching element has a switching pin having a line of influence extending in an axial direction thereof, wherein the stop cam has an inclined surface, and wherein the line of influence of the switching pin extends perpendicularly of the inclined surface of the stop cam and the line of influence extends inclined relative to a vertical axis of the paper shredder.

2. The safety switch for paper shredders according to claim 1, wherein the stop cam for actuating the safety switch is located a significant vertical distance below an imaginary point of rotation formed by a contact between the cutting mechanism housing and the upper edge of the collecting container.

3. The safety switch for paper shredders according to claim 1, wherein the switching pin is located on a rear side of the housing and in an interior of a gap-like narrow recess of the rear side of the housing.

4. The safety switch for paper shredders according to claim 3, wherein the gap-like narrow recess has a gap depth, and wherein the gap depth is formed by two parallel ribs protruding from the rear side of the housing.

5. The safety switch for paper shredders according to claim 4, wherein the upper edge of the collecting container has an increased thickness portion, and wherein the stop cam for the switching pin is located forwardly flush in a recess of the increased thickness portion.

6. The safety switch for paper shredders according to claim 5, wherein the recess in the increased thickness portion has a depth and a width adapted to outer dimensions of the ribs at the rear side of the housing.

* * * * *